US006913261B2

(12) United States Patent
Khalil

(10) Patent No.: US 6,913,261 B2
(45) Date of Patent: Jul. 5, 2005

(54) LEO CHESS

(76) Inventor: Mourad Khalil Aziz Khalil, 6652 Berquist Ave., West Hills, CA (US) 91307-3303

( * ) Notice: Subject to any disclaimer, the term of this patent is extended or adjusted under 35 U.S.C. 154(b) by 100 days.

(21) Appl. No.: 10/347,062

(22) Filed: Jan. 17, 2003

(65) Prior Publication Data

US 2004/0140615 A1 Jul. 22, 2004

(51) Int. Cl.[7] ..... A63F 3/00
(52) U.S. Cl. ..... 273/260; 273/261; 273/262
(58) Field of Search ..... 273/260, 261, 273/262

(56) References Cited

U.S. PATENT DOCUMENTS 5,513,849 A * 5/1996 Navin ..... 273/261
5,690,334 A * 11/1997 Duke ..... 273/261
6,095,523 A * 8/2000 Lampman ..... 273/260

* cited by examiner

*Primary Examiner*—Vishu K. Mendiratta

(57) ABSTRACT

A method of playing a modified chess game by introducing a new piece in the shape of a lion to be called Leo. The Leo moves two squares in any direction selected from any of the diagonal, vertical or horizontal directions, moving forward and backward, leaping over other pieces and may capture in its destination squares in addition to the two square diagonally adjacent to the front of its only. Each of the two playing sets consists of the sixteen pieces of the orthodox chess game plus two Leo pieces and two extra pawns. The game board consists of 100 squares in alternating light and dark colors, arranged in ten rows by ten columns. The Leos' starting positions are one beside the king and one beside the queen. When castling, the king moves to either of the knight's starting positions and the involved rook moves over the king to the corresponding bishop's starting position.

1 Claim, 5 Drawing Sheets

LEO CHESS

REFERENCES CITED

U.S. Patent Documents

U.S. Pat. No. 5,513,849, 05/1996 Navin.

U.S. Pat. No. 5,690,334, 11/1997 Duke.

U.S. Pat. No. 5,735,523, 04/1998 Fioriglio.

U.S. Pat. No. 6,095,523, 08/2000 Lampman.

STATEMENT REGARDING FEDERALLY SPONSORED RESEARCH OR DEVELOPMENT

"Not applicable".

REFERENCE TO SEQUENCE LISTING, A TABLE, OR A COMPUTER PROGRAM LISTING COMPACT DISC APPENDIX

"Not applicable".

BACKGROUND OF THE INVENTION

1) This invention aims at introducing a method of playing a modified chess game by providing a new piece in pair for each set of pieces. This piece is distinguished by strong functions in order to improve the standard orthodox chess game and innovate new strategies and tactics for the game.
2) The standard orthodox chess game is played by two players against each other, wherein each set of playing pieces consists of the following sixteen pieces: one king, one queen, two bishops, two knights, two rooks and eight pawns.
3) The moves of the pieces of the orthodox chess game are well known, and are outlined in U.S. Pat. Nos. 5,735, 523 and 5,690,334.

BRIEF SUMMARY OF THE INVENTION

This invention is called Leo Chess, and its is a method of playing a modified chess game aiming at improving and enhancing the game. This will result in innovating new strategies and tactics for the game, as well as enriching the probabilities and options available, especially during the opening and the middle of the game. The invention includes the following elements:

1) Introduction of a new piece called Leo that is provided in pair for each of the two sets of the playing pieces in addition to the orthodox chess game pieces.
2) The new Leo piece functions by moving two squares in any direction selected from any of the diagonal directions, the vertical directions or the horizontal directions, moving forward and backward, leaping over other pieces and may capture ay of the opponent's pieces that may exist in its destination squares in addition to the two squares diagonally adjacent to the front of it only.
3) Providing two extra pawns for each set of pieces in addition to the orthodox chess game pieces.
4) Using a game board consisting of 100 squares in alternating light and dark colors, arranged in 10 rows by 10 columns.
5) The starting positions for the two new Leo pieces are one beside the king and one beside the queen in the two squares horizontally adjacent to them.
6) Pawns' movement rules are the same as in the orthodox chess game except that each pawn, on its first move, can move forwardly up to three squares in one move.

7) Similar to the orthodox chess game, the game board is placed so that each player should have on his/her side a light colored square at the lower right hand corner of the board.
8) The movement rules of the king and the rook are the same as in the orthodox chess game, except for the castling move, where the king is to move to either of the knights' starting positions in either direction and the rook is to move two squares to the square horizontally adjacent to the king's castling position i.e. to either of the bishops' starting positions.

The advantages of this invention are:

1) Introducing a new method of playing a modified chess game by providing the new Leo piece with distinct functions that have a significant effect on improving the game and enhancing the strategies and tactics of the game.
2) Using a 100 square game board with the new Leo pieces and the extra pawns will result in enriching the probabilities and options available within the opening and the middle of the game.
3) The new rule for the castling move provides more safety for the king in order to balance the extra threat resulting from the new Leo pieces, the extra pawns, and the larger game board.

BRIEF DESCRIPTION OF THE SEVERAL VIEW OF THE DRAWING

FIG. 1 is an illustration of the following:

a) As indicated by lead line 1 showing an example of a Leo piece removed from its starting position and placed in the fourth square of the fifth row to show the possible movements of that piece i.e. two squares move diagonally, vertically and horizontally.
b) As indicated by lead lines 2 thru 8 showing the starting positions of the Leo pieces (see line 4) in the two squares horizontally adjacent to the king's and the queen's starting positions, the starting position of the light colored king (see line 2) in the dark square number five of the first row and the dark colored king (see line 8) in the opposing light square of the tenth row, and the starting positions of the queens, bishops, knights and rooks (see lines 3, 5, 6 and 7 respectively).
c) The starting positions of the rest of the pieces.
d) The 100 square game board, wherein each of the two playing sets consists of one king, one queen, two Leos, two bishops, two knights, two rooks and ten pawns.

Figure 1:
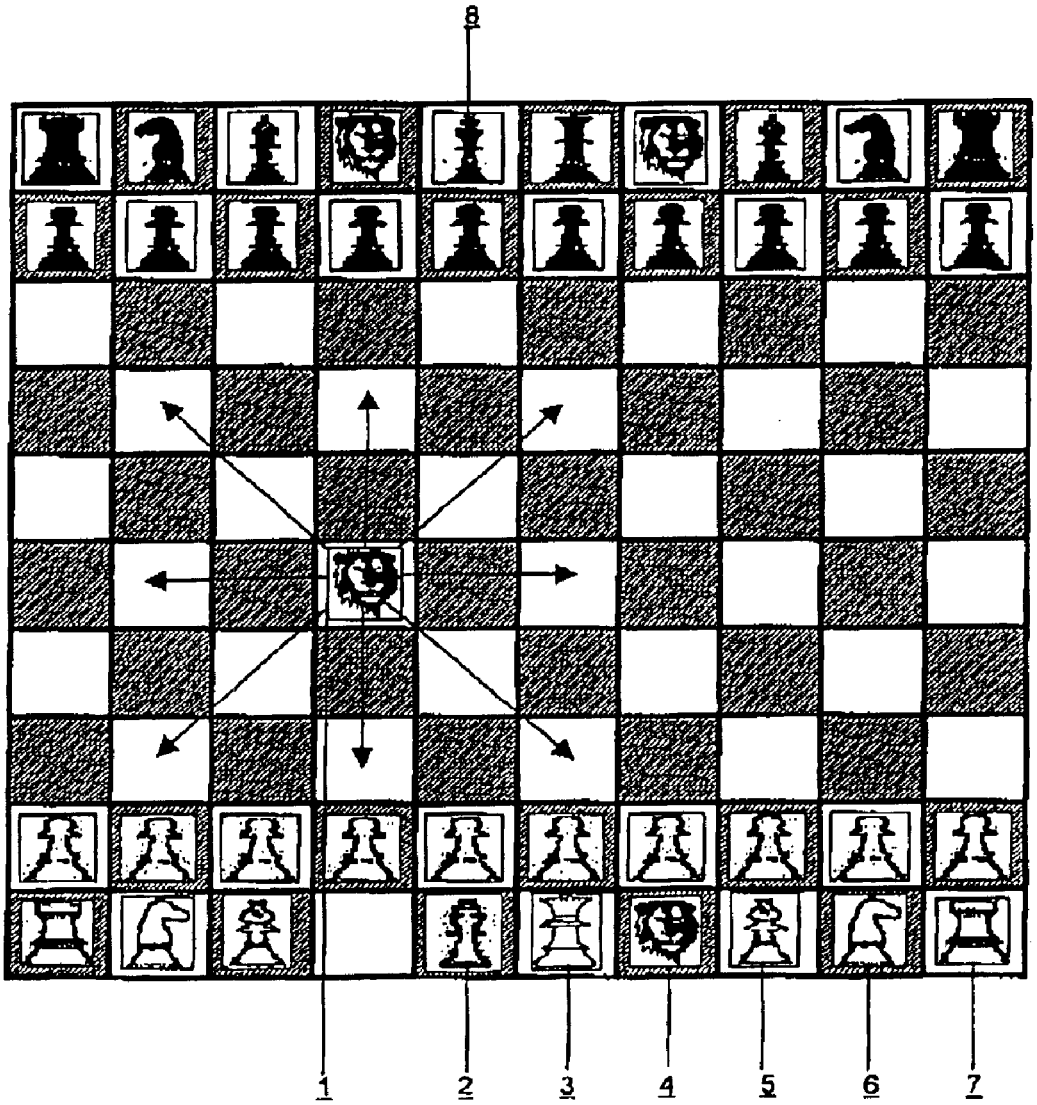

Lead line 1: The Leo captures a knight. This is one of the two possible horizontal directions i.e. left or right.

Lead line 2: The Leo captures a pawn existing in one of the two squares diagonally adjacent to the front of it and captures a rook existing in its forward diagonal destination square.

Lead line 3: The Leo captures a bishop in one of the two squares diagonally adjacent to the front of it and move to its forward diagonal destination square.

Lead line 4: The Leo captures a pawn and leaps over the opponent's knight, which can't be captured by the Leo since it's in a square diagonally adjacent to the back of that Leo.

Lead line 5: The Leo captures a queen. This is one of the two possible vertical directions i.e. forward or backward.

Lead line 6: The leo captures a rook by passing through an empty square. This is one of the two possible forward diagonal directions.

Lead line 7: The leo moves to an empty forward diagonal destination square by leaping over the opponent's pawn.

Lead line 8: The leo captures a bishop by passing through an empty square. This is one of the two possible backward diagonal directions.

Figure 4:
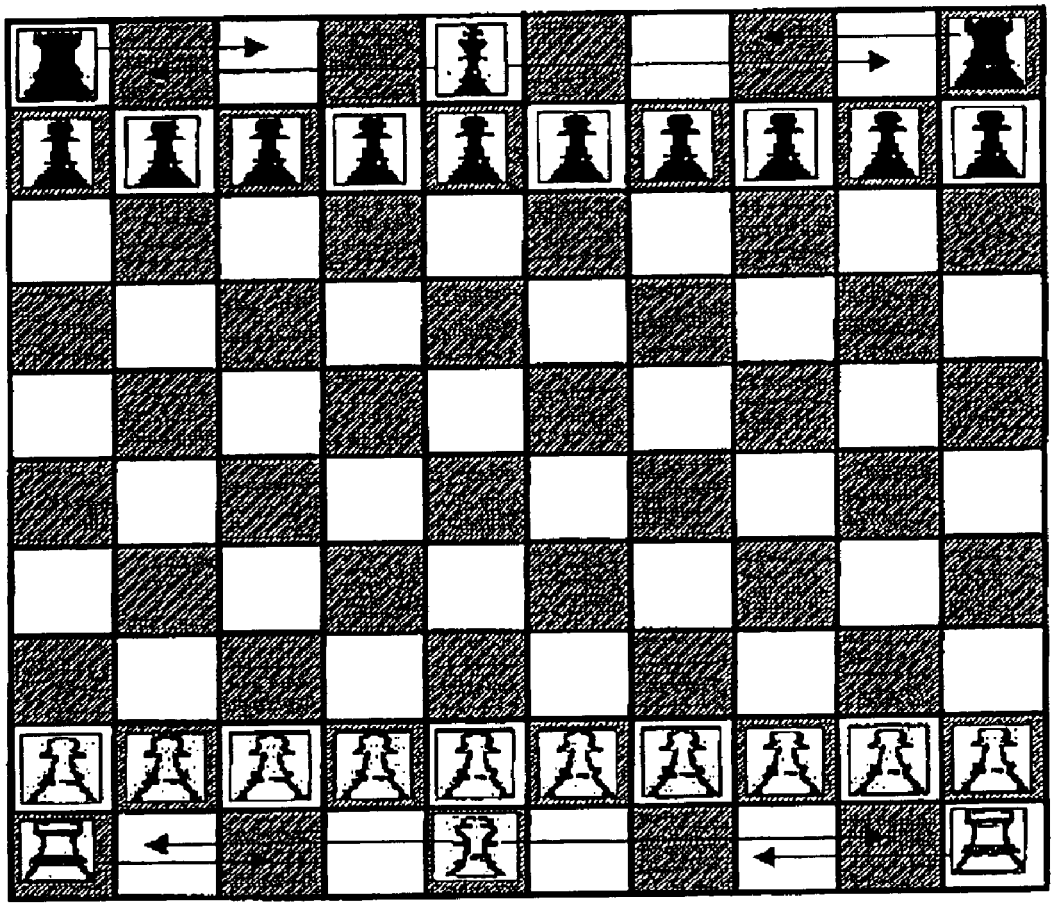

FIG. 4 is a view of the new castling move, wherein the king moves to either square of the knights' starting positions and the rook moves two squares horizontally to the square adjacent to that of the king's i.e. to either square of the bishops starting positions.

Figure 5:
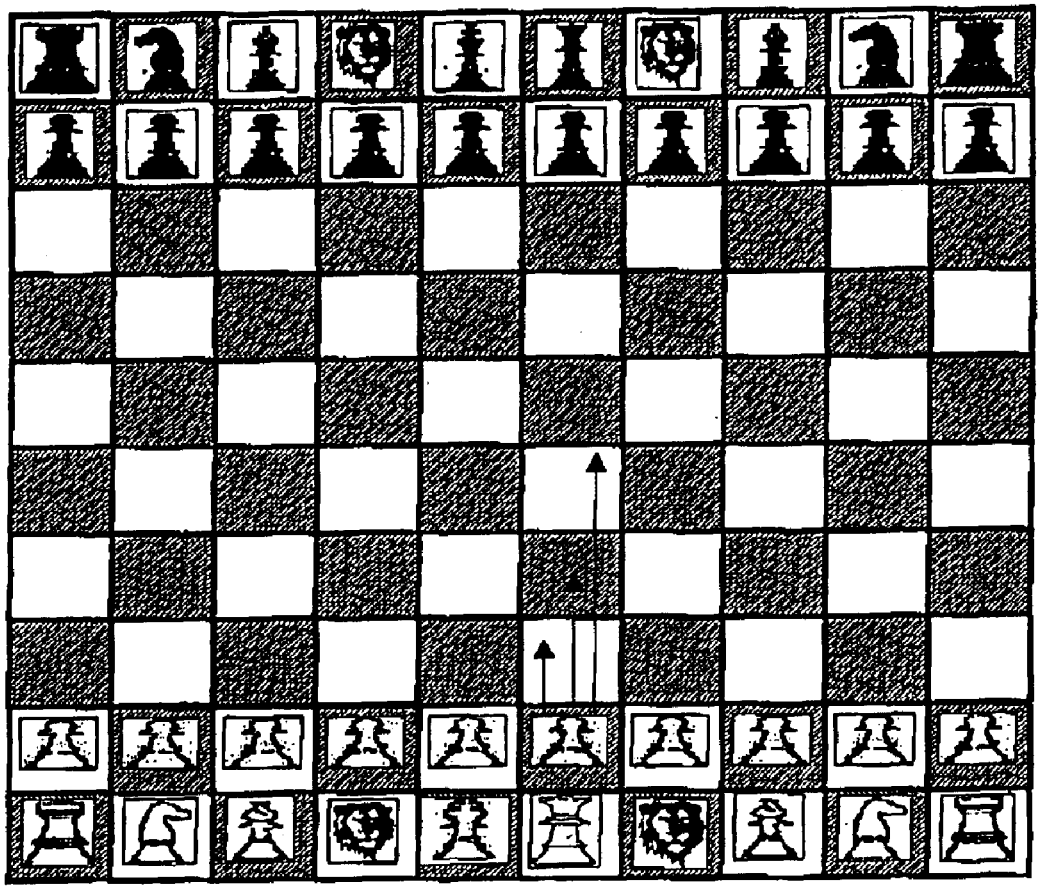

FIG. 5 is a view illustrating the possible alternatives for the initial move for any pawn, moving straight for one, two or three squares.

DETAILED DESCRIPTION OF THE INVENTION

Figure 2:
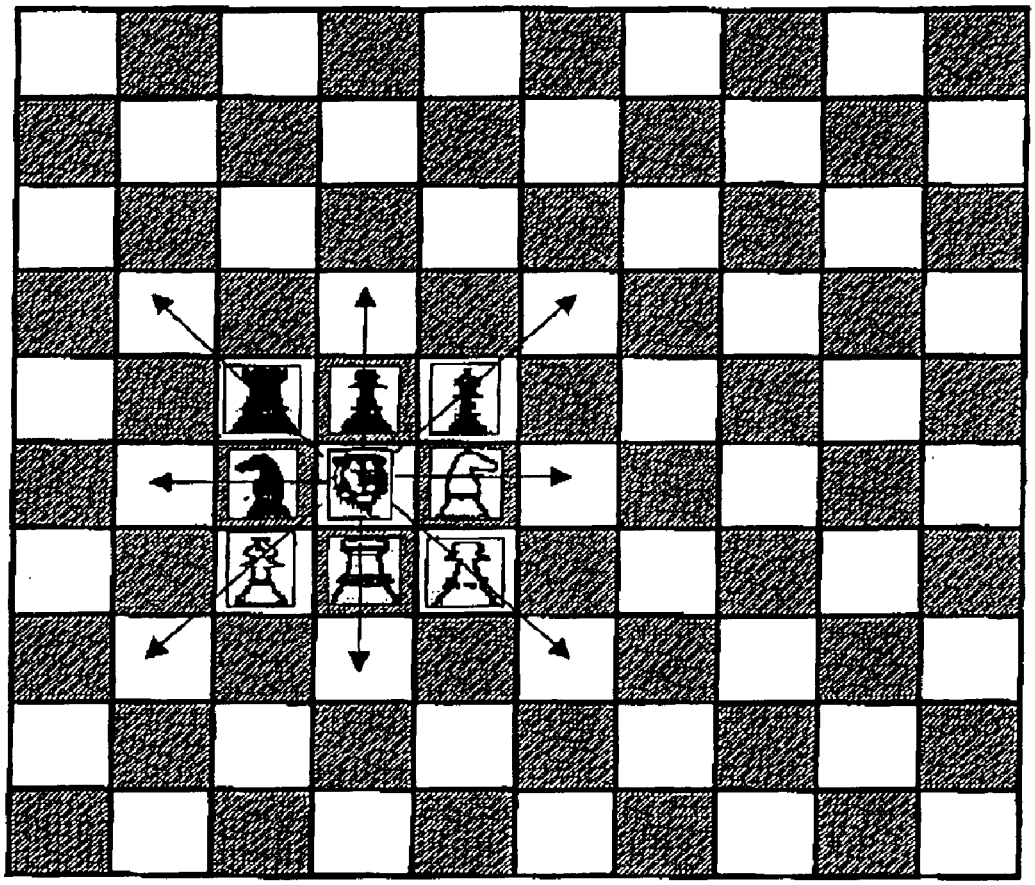
FIG. 2 is a view of the Leo piece moving two squares in all directions by leaping over other pieces.
Figure 3:
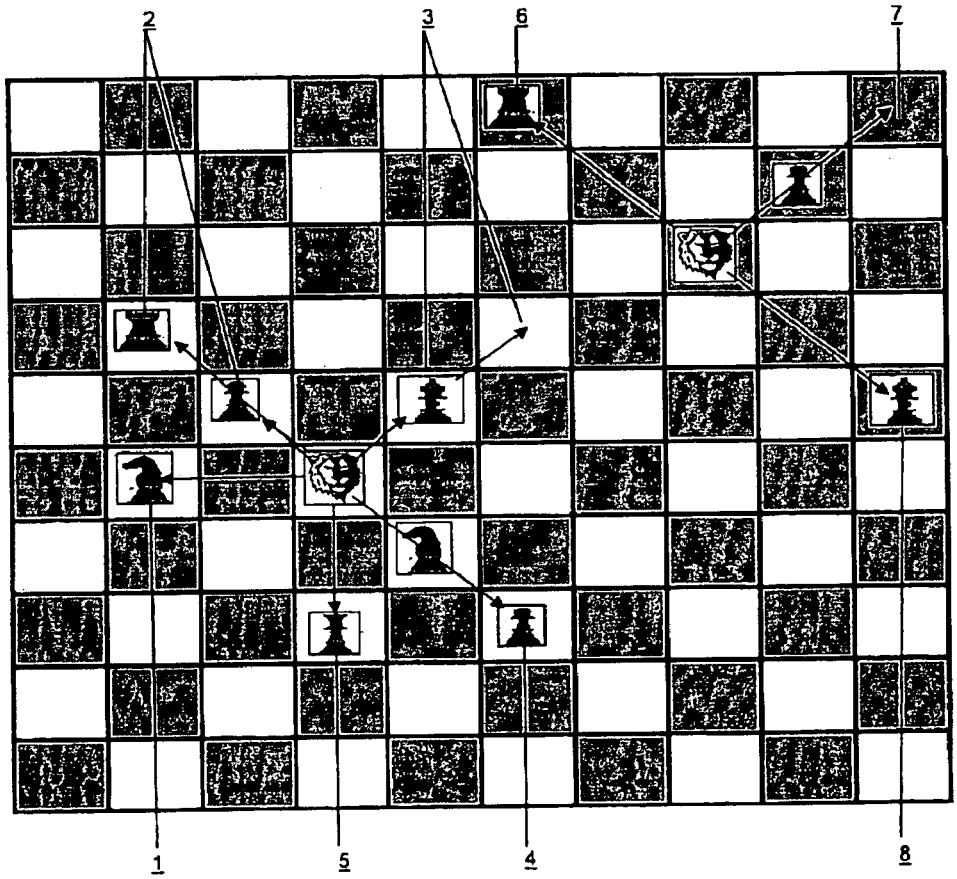
FIG. 3 is a view illustrating the capturing functions of the Leo piece where it may capture pieces in its destination squares in addition to the two squares diagonally adjacent to the front of it only. Lead lines 1 thru 8 in this view indicate the following cases.

1. This invention is a method of playing a modified chess game by two players against each other, wherein a new piece in the shape of a lion is introduced and is called Leo. The new piece is provided in pair for each player and is to function by moving two squares in any direction selected from any of the diagonal directions, the vertical directions or the horizontal directions, moving forward and backward, leaping over other pieces and may capture any of the opponent's pieces that may exist in its destination squares in addition to the two squares diagonally adjacent to the front of it only. The movement and capturing rules of the Leo piece are illustrated in FIGS. 1, 2 and 3 as follows:
   a) In FIG. 1 lead line 1 is pointing to a Leo piece removed from its starting position and placed in the fourth square of the fifth row to show the possible moves available to its destination squares.
   b) In FIG. 2 the rule of leaping over any other piece is shown, wherein the surrounding pieces in the adjacent squares to the Leo do not block its move to or capture at any of its possible destination square.
   c) In FIG. 3 the capturing rules are clarified, wherein lead lines 1 thru 8 point to the following alternatives:
      1—The Leo captures a knight. This is one of the two possible horizontal directions i.e. left or right.
      2—The Leo capture a pawn existing in one of the two squares diagonally adjacent to the front of it and captures a rook existing in its forward diagonal destination square.
      3—The Leo captures a bishop in one of the two squares diagonally adjacent to the front of it and move to its forward diagonal destination square.
      4—The Leo captures a pawn and leaps over the opponent's knight, which can't be captured by the Leo since it's in a square diagonally adjacent to the back of that Leo.
      5—The Leo captures a queen. This is one of the two possible vertical directions i.e. forward or backward.
      6—The leo captures a rook by passing through an empty square. This is one of the two possible forward diagonal directions.
      7—The leo moves to an empty forward diagonal destination square by leaping over an opponent's pawn.
      8—The leo captures a bishop by passing through an empty square. This is one of the two possible backward diagonal directions.
2. There are two sets of light and dark colored playing pieces to be provided, one set for each player, and each set is twenty pieces comprised of the sixteen orthodox chess pieces, the two Leo pieces and two extra pawns. Explicitly, each set consists of one king, one queen, two Leos, two bishops, two knights, two rooks, and ten pawns.
3. Leo Chess requires a game board consisting of 100 squares in alternating light and dark colors, arranged in ten horizontal rows by ten vertical columns as seen in FIGS. 1 thru 5.
4. Similar to the orthodox chess game, the game board is placed so each player should have on his side a light colored square at the lower right hand corner of the board as seen in FIGS. 1 thru 5.
5. At the start of the game the light colored pieces are placed in the first row from left to right in the following sequence: rook, knight, bishop, Leo, king, queen, Leo, bishop, knight and rook, with the ten pawns placed in the ten squares of the second row. As seen in FIG. 1, lead lines 2 thru 7 point out the following:
   a) Lead line 2 points to the light colored king in its starting position in the fifth square of the first row on a dark colored square.
   b) Lead line 3 points to the light colored queen in its starting position in the sixth square of the first row on a light colored square.
   c) Lead line 4 points to one of the light colored Leos in its starting position in the seventh square of the first row, whereas the starting position of the second light colored Leo is in the fourth square of the first row. In FIG. 1, lead line 1 points to one of the two light colored Leos, which has been removed from its starting position and placed in the fourth square of the fifth row to illustrate the possible moves of the Leo piece. Simply and precisely, the starting positions of the two Leos are one beside the king and one beside the queen.
   d) Lead lines 5, 6 and 7 are pointing to a light colored bishop, knight and rook in their starting positions in the eighth, ninth and tenth squares of the first row respectively. The starting position of the second light colored bishop, knight and rook are in the third, second and first squares of the first row respectively.
6. A the start of the game the dark colored pieces are placed in the tenth row at the opposing end of the game board from left to right in the following sequence: rook, knight, bishop, Leo, king, queen, Leo, bishop, knight, rook, with the ten pawns placed in the ten squares of the ninth row. To avoid confusion in placing the pieces, lead line 8 in FIG. 1 points to the dark colored king in order to clarify that its starting position is in the fifth square of the tenth row on a light colored square.
7. The movement rules for each of the queen, the bishops and the knights are the same movement rules as of its corresponding piece in the orthodox chess game.
8. The movement rules for each king are the same rules as in the orthodox chess game, except that in the castling move the king has to move to either square of its knights' starting positions i.e. the second or ninth square of the first row for the light colored king, or the second or ninth square of the tenth row for the dark colored king. FIG. 4 shows the directions of the kings' moves and the intended destination squares for castling as indicating by the lead lines. The other rules for castling are the same as that of the orthodox chess game.

9. The movement rules for each rook are the same rules as in the orthodox chess game, except that in the castling move the rook has to move only two squares in either direction to be placed after the kings' castling position in the square horizontally adjacent to the king, i.e. moving to either bishop starting position square. FIG. 4 shows the direction of the rooks and the intended destination squares for castling as indicated by the lead lines.

10. The movement rules for play for each pawn are the same rules as in the orthodox chess game except that each pawn, on its first move, can move forwardly up to three squares. FIG. 5 shows the possible initial moves for any pawn as indicated by the lead lines where any pawn can make a straight move of one, two or three squares only during its first move.

11. All rules of the orthodox chess game are applicable to this invention, except as otherwise specified in this invention.

What I claim as my invention is:

1. A method of playing a modified chess game by two players against each other, comprising the steps of:

a) introducing a new piece called Leo in the shape of a lion provided in pair for each player;

b) formatting rules for movement wherein each of the lens may move two squares in any direction selected from any of the diagonal directions, the vertical directions or the horizontal directions;

c) formatting rules for movement wherein each of the leos may make its move in the forward direction or in the backward direction;

d) formatting rules for movement wherein each of the leos may make its move by leaping over other pieces;

e) formatting rules for movement wherein each of the leos may capture any of the opponent's pieces that may exist in its destination squares, in addition to the two squares diagonally adjacent to the front of it only;

f) providing two sets of light and dark colored playing pieces, each set consists of one king, one queen, two Leos, two bishops, two knights, two rooks and ten pawns;

g) providing a game board consisting of 100 squares in alternating light and dark colors arranged in ten horizontal rows by ten vertical columns;

h) placing the game board wherein each player should have on his/her side a light colored square at the lower right hand corner of the board;

i) placing the set of light colored playing pieces at the start of the game in the first row starting from left to right in the following sequence: rook, knight, bishop, Leo, king, queen, Leo, bishop, knight and rook, whilst the ten pawns are placed in the ten squares of the second row;

j) placing the set of dark colored pieces at the start of the game in the tenth row at the opposing end of the game board starting from left to right in the following sequence: rook, knight, bishop, Leo, king, queen, Leo, bishop, knight and rook, whilst the ten pawns are placed in the ten squares of the ninth row;

k) the movement rules for each of the queens, bishops and knights are the same rules of movement as its corresponding piece in the orthodox chess game;

l) the movement rules of the king and the rook are the same as in the orthodox chess game, except that in the castling move the king moves from its starting position to either of the knights' starting positions in either direction, and the involved rook moves two squares from its starting position to be placed after the king in the square horizontally adjacent to the king's castling position i.e. to either of the bishops' starting positions;

m) the movement rules for each pawn are the same rules as in the orthodox chess game except that each pawn, on its first move, can make a forward straight move of one, two or three squares.

* * * * *